United States Patent [19]

Godfrey

[11] 4,176,753

[45] Dec. 4, 1979

[54] HANGING FILE SUPPORT FRAME

[75] Inventor: Steven W. Godfrey, Florence, Ky.

[73] Assignee: Hunt Manufacturing Co., Philadelphia, Pa.

[21] Appl. No.: 932,263

[22] Filed: Aug. 9, 1978

[51] Int. Cl.[2] ..... A47F 5/10

[52] U.S. Cl. ..... 211/182; 211/189; 312/184; 403/172

[58] Field of Search ..... 211/182, 46, 183, 189; 312/184; 403/171, 170, 172, 176, 217, 396

[56] References Cited

U.S. PATENT DOCUMENTS

| | | | |
|---|---|---|---|
| 3,006,669 | 10/1961 | Novales | 403/217 |
| 3,360,883 | 1/1968 | Glanzer | 403/397 X |
| 4,030,610 | 6/1977 | Alexander | 312/184 X |
| 4,049,127 | 9/1977 | Alexander | 312/184 X |
| 4,091,933 | 5/1978 | Alexander | 312/184 X |

*Primary Examiner*—Roy D. Frazier
*Assistant Examiner*—Robert W. Gibson, Jr.
*Attorney, Agent, or Firm*—Harding, Earley & Follmer

[57] ABSTRACT

A hanging file support frame has a pair of file folder support rails and four corner fittings mounted on legs. Each corner fitting has a bottom wall, a rear wall and a flexible top wall forming a first opening for the reception of one end of a rail. The top and bottom walls form a front entry into the first opening for the passage of said one end of a rail into said first opening in a direction transverse to the length of the rail. The rear wall is substantially thicker than the top wall and the top wall is cantilevered from the rear portion of the rear wall. Flanges releasably lock the rail end into the first opening. A transverse member having hollow ends has one end passing through a second opening in the rear wall. A rail backing wall in the first opening of each corner fitting depends from the top wall and has a boss extending toward the second opening and received in the hollow end of a transverse member for restraining the movement of the depending wall and the top wall to prevent inadvertent disengagement of a rail end from the corner fitting.

3 Claims, 7 Drawing Figures

HANGING FILE SUPPORT FRAME

TECHNICAL FIELD

This invention is in the field of filing systems.

BACKGROUND OF PRIOR ART

Hanging file folder support frames having support rails, corner fittings supported on legs and transverse members secured to the corner fittings are known to the art. Such a support frame having a generally C-shaped opening for the side entry of a rail is shown in U.S. Pat. No. 4,030,610. It is also known in the prior art to cantilever the top of the C-shaped corner fitting from the front portion of a rear wall which is thicker than the top wall. In accordance with the invention, a superior arrangement for controlling the flexing of the top wall to permit entry of the end of a side rail with facility and yet prevent its inadvertent dislodgment from the opening is provided.

BRIEF SUMMARY OF THE INVENTION

A hanging file support frame has a pair of file folder support rails and four corner fittings mounted on legs. Each corner fitting has a bottom wall, a rear wall and a flexible top wall forming a first opening for the reception of one end of a rail. The top and bottom walls form a front entry into the first opening for the passage of said one end of a rail into said first opening in a direction transverse to the length of the rail. The rear wall is substantially thicker than the top wall and the top wall is cantilevered from the rear portion of the rear wall. Flanges releasably lock the rail end into the first opening. A transverse member having hollow ends has one end passing through a second opening in the rear wall. A rail backing wall in the first opening of each corner fitting depends from the top wall and has a boss extending toward the second opening and received in the hollow end of a transverse member for restraining the movement of the depending wall and the top wall to prevent inadvertent disengagement of a rail end from the corner fitting.

DETAILED DESCRIPTION OF THE INVENTION

Figure 1:
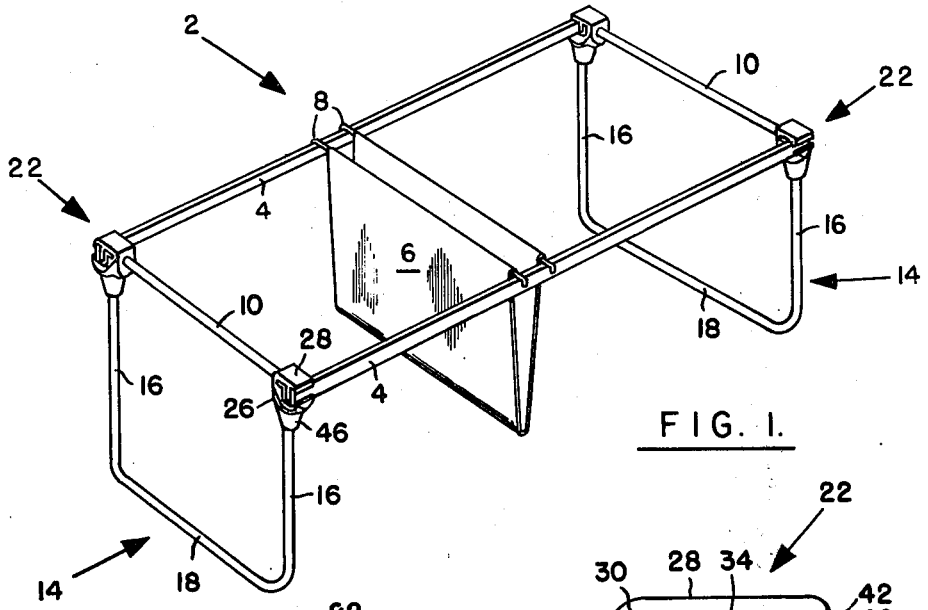
FIG. 1 is a side perspective view of a hanging file support frame in accordance with the invention.
Figure 2:
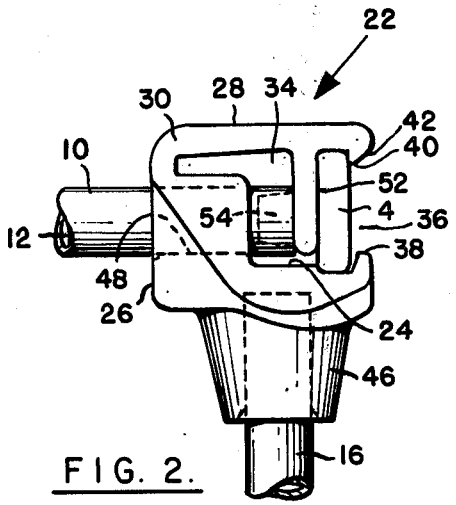
FIG. 2 is an end elevation of a corner fitting the support frame of FIG. 1.

A hanging file support frame 2 in accordance with the invention has a pair of support rails 4,4 for supporting file folders such as the file folder 6 having sliders 8 which are adapted to slide along rails 4,4. Support frame 2 has a pair of transverse members 10,10 each having a hollow interior 12. A pair of end support members 14,14 each having upstanding legs 16,16 connected at their lower ends by a cross member 18.

Four corner fittings 22 each having a bottom wall 24, a rear wall 26 and a flexible top wall 28 which is cantilevered from the rear portion of rear wall 26 as indicated at 30. Walls 24, 26 and 28 form an opening 34 an entry 36 to which being formed by bottom wall 24 and top wall 28. Bottom wall 24 has an upwardly extending flange 38 and top wall 28 has a downwardly extending flange 40 with a cam portion 42 to facilitate the entry of a support rail into opening 34.

Bottom wall 24 has a depending hollow boss 46 for the reception of a leg 16 of an end support 14. Rear wall 26 which is relatively thick and substantially thicker than top wall 28 has an opening 48 through the wall for the reception of one end of a transverse member 10.

A rail backing wall 52 depends from the top wall 28 into opening 34 and has a truncated conical boss 54 which is received by a pressed fit in the adjacent end of a transverse member 10.

Preferably the corner fittings 22 are constructed from a resilient synthetic resin, for example, a polyamide resin, for example, nylon or an acetal resin such as DELRIN sold by E. I. DuPont de Nemours & Co., Inc., Wilmington, Delaware. Other materials conventionally used to form support frames can be used. Thus a metal such as aluminum is satisfactory. The remaining parts are preferably made of metal such as steel or aluminum.

Figure 7:
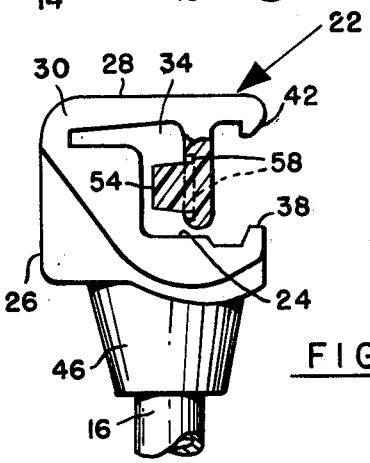
FIG. 7 is an end elevation of the corner fitting of FIG. 2, partially broken away, with a material accumulating groove added.
Figures 3, 4, 5, 6:
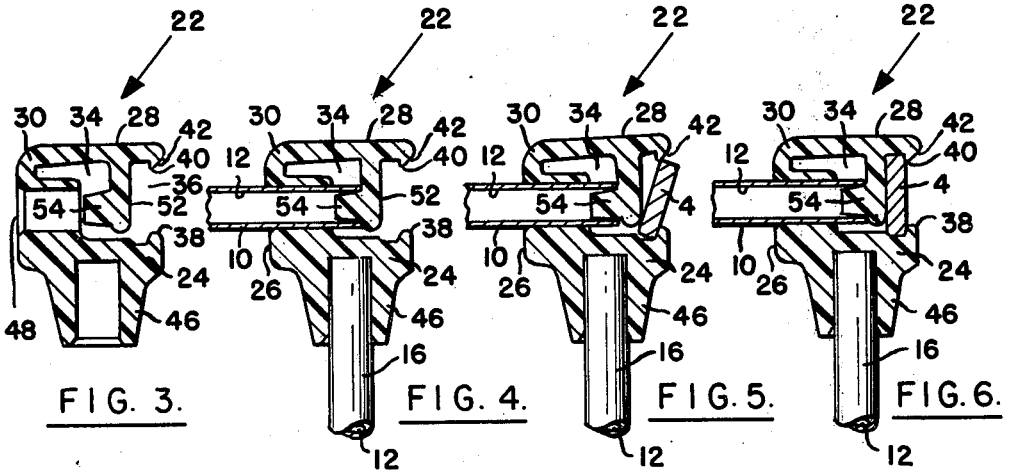
FIG. 3 is a vertical section through the corner fitting of FIG. 2 before the file folder support rail is inserted.
FIG. 4 is a vertical section through the corner fitting of FIG. 2 with the device fully assembled.
FIG. 5 is a vertical section, partially broken away, of the corner fitting of FIG. 2 showing the support rail being inserted.
FIG. 6 is a vertical section, partially broken away, of the corner fitting of FIG. 2 with the support rail in place.

In assembling file folder support frame 2, the bosses 46 of the corner fittings 22 are telescoped over the upper ends of legs 16 of end supports 14. The transverse members 10 are then inserted through the openings 48 in fittings 22 with each end being thrust home until it is telescoped over the adjacent boss 54. Each end of each rail 4 is then inserted into the adjacent corner fitting 22 by placing the lower portion of the rail inside of flange 38 onto bottom wall 24 and then rotating the rail to force the upper edge past cam surface 42 of flange 40 until it snaps behind flange 40 and against rail support wall 52. As the rail is being inserted, flexible top wall 28 flexes upwardly carrying with it rail support wall 52. The upward movement of rail support wall 52 is resisted by the engagement of boss 54 by transverse member 12. By the same token, the inadvertent removal of the end of a rail 4 from its associated fitting 22 is resisted by the interaction of boss 54 and transverse member 12. As seen in FIG. 7, a peripheral groove 58 may be placed in wall 52 adjacent the inner end of boss 54. In the event that material is scraped off the exterior of boss 54 when a transverse member 10 is telescoped over it, such material will be forced into groove 58 where its accumulation rather than on the face of wall 52 will permit transverse member 10 to butt up against wall 52.

It will be understood that the above-described embodiment is illustrative and is not intended to be limiting.

I claim:

1. A hanging file folder support frame comprising:

a pair of file folder support rails, four corner fittings, legs supporting the corner fittings in an elevated position, each corner fitting having a bottom wall, a rear wall, and a flexible top wall forming a first opening for the reception of one end of a rail, the top and bottom walls forming a front entry into said first opening for the passage of said one end of a rail into said first opening in a direction transverse to the length of the rail, said rear wall being substantially thicker than the top wall, and the top wall being cantilevered from the rear portion of the rear wall, means integral with the top and bottom walls of each corner fitting for releasably locking the rail end into the first opening, a pair of transverse members each having hollow ends, the rear wall of each corner fitting having a second opening therethrough for the reception of one end of a transverse member, and a rail backing wall in said first opening of each corner fitting depending from the top wall and having a boss extending towards the second opening in the rear wall and received in the hollow end of a transverse member for restraining the movement of the depending wall and the top wall to prevent inadvertent disengagement of a rail end from the corner fitting.

2. A hanging file folder support frame in accordance with claim 1 in which the means for releasably locking the rail end into the first opening comprises an upwardly extending flange on the bottom wall and a downwardly extending flange on the top wall.

3. A hanging file folder support frame in accordance with claim 1 in which the boss on the rail backing wall tapers inwardly as it extends away from the rail backing wall.

* * * * *